United States Patent [19]

Saint Clair

[11] 4,139,216

[45] Feb. 13, 1979

[54] WRAP AROUND COVER

[76] Inventor: Donald F. Saint Clair, Fenimore Rd., R.D.1, Medford, N.J. 08055

[21] Appl. No.: 821,737

[22] Filed: Aug. 4, 1977

[51] Int. Cl.[2] ..... B42D 3/04

[52] U.S. Cl. ..... 281/4; 281/19 R; 281/25 A; 281/34

[58] Field of Search ..... 281/29, 34, 1, 3 R, 281/4, 15 R, 17, 19 R, 25 A; 428/134, 136

[56] References Cited

U.S. PATENT DOCUMENTS

| | | | |
|---|---|---|---|
| 1,126,878 | 2/1915 | Schaefer | 281/29 X |
| 1,510,213 | 9/1924 | Ewing | 281/29 |
| 2,027,497 | 1/1936 | Smith | 281/19 R X |
| 2,200,146 | 5/1940 | Block | 281/25 A X |
| 3,586,085 | 6/1971 | Torongo | 281/19 R |

*Primary Examiner*—Travis S. McGehee

*Attorney, Agent, or Firm*—Weiser, Stapler & Spivak

[57] ABSTRACT

A wrap around cover for enclosure of mechanically bound papers is disclosed. More particularly, the cover fully encloses all four sides of a booklet or stack of bound papers in a single wrap around sheet to provide enhanced protection and aesthetic appearance. The cover comprises an integral blank of foldable material, the blank being scored and punched if necessary at predetermined locations prior to binding to accommodate both the type of binder and the size and number of pages being bound.

16 Claims, 10 Drawing Figures

WRAP AROUND COVER

BACKGROUND OF THE INVENTION

The present invention relates generally to covers for books, booklets, pamphlets and the like, and more particularly, to a cover which encloses all four sides of a volume in a single wraparound sheet.

The burgeoning production of industrial reports, periodicals, specially prepared teaching materials and other publications has given rise to a variety of relatively inexpensive binding processes of various complexities. Some are simply stapled or attached with post-type binders. Others utilize bars of plastic situated on either side of a stack of pages having perforations under the position of the bars. Connecting portions extend from at least one of the bars through the perforations to the other to join the opposing bar, and thereby lock the stack of papers therebetween. In these and other manners, a pre-selected collection of pages can be securely bound in an inexpensive manner.

The existing methods of binding, while usually adequate for the service, have proved somewhat deficient from an aesthetic viewpoint wherein the bound product presented an unfinished appearance.

Typical of the devices which have been developed by prior workers in the art to protect pages bound in this way and to produce a better visual appearance have included merely adding, as a first and last page, cover sheets of heavier grade paper. Such cover sheets could be employed decoratively in addition to serving as both a title page and a source of some protection. Such cover sheets, however, have not provided protection for the edges of the bound pages, the portion which, under storage or library conditions, is most visible and most susceptible to wear and discoloration through use. Also, the spine surface of the page edges is left exposed and unfinished by incorporating front and back cover pages. Such an unfinished edge cannot be imprinted and thus, a collection of such bound volumes cannot provide information to distinguish one volume from another while positioned on a shelf.

Other efforts have been made to more completely protect the enclosed pages of simply bound stacks of pages. Such further attempts have included, among others, the use of a spine enclosing member, usually of plastic, slidably fitting along the length of both sides of binding bars to enclose the binding means and the spine edge of the bound pages. These have typically not provided the width and surface characteristics necessary for imprinting the information normally included in hard bound books as described above. Further, the remaining edges of the bound pages continued to be unprotected and present an unattractive appearance. Other attempts have been made to provide a cover wherein a single sheet of covering grade paper or plastic sheet is used which continues as a front and back page. In such a construction, the remainder of the page edges continue to be unprotected.

In a different context, it has been known to use backers for the enclosure of legal papers. These backers consist of a single sheet of light grade paper which is stapled to the front of the document. It is then folded up and over the document so as to cover the back thereof, resulting in an upper border which covers the staples in front as well as providing a sheet to protect the back page. The document is then folded so that only the backer is facing the exterior. This provides some protection but is obviously not applicable for use with bound volumes which are not intended to be folded.

Therefore, despite the activity of prior workers in the field, there has not to date been developed a means for presenting inexpensively bound volumes in an aesthetic manner, approximating that of conventional, glue bound, hard cover books. Nor has there been provided satisfactory means for protection of the contents in a simple and inexpensive manner.

SUMMARY OF THE INVENTION

The present invention relates generally to wrap around covers for the bound enclosure of stacked pages and an integral blank of foldable material therefor. More particularly, the invention relates to a cover which fully encloses all four sides of a volume in a single wrap around sheet.

The single piece wrap around cover provided by the present invention is used for the bound enclosure of books, booklets, stacked papers and the like and comprises an integral, pre-scored cover blank. In one embodiment of the invention, the cover blank must be punched to accommodate portions of the sheet fastening system by providing a plurality of openings therefore. The plastic binders produced by Velo-Bind, Inc., Sunnyvale, California and the plastic ring binder produced by General Binding Corporation are exemplary of such systems. In other embodiments, for example, when used with the king strip binder of General Binding Corporation, the cover sheet need not be prepunched.

The cover blank of the first embodiment comprises a binding panel having a plurality of perforations punched therethrough; a reflex panel contiguous with the bending panel; a spine panel contiguous with the reflex panel; a back panel contiguous with the spine panel; an end panel contiguous with the back panel; and a front panel contiguous with the back panel. The front panel extends toward and sometimes under the reflex panel to effect complete enclosure of the bound pages. The cover is constructed of a generally sturdier material than the inside sheets, such as plastic, heavy paper or cardboard, but this extra weight is not mandatory. Thus, enhanced protection for the bound papers is somewhat provided by the increased strength of the cover material. The reflex panel may be provided with an additional prescored fold line to allow folding to an angular configuration having an apex extending upwardly from the bound volume to accommodate the page fastener or binder by providing thereby some additional space. The apex formed by this embodiment of the reflex panel will rise only slightly from the binder to thus add but little additional bulk to the bound materials. Preferably, the spine panel is a flat surface generally perpendicular to the back and front panels.

The present invention also relates to an integral blank of foldable material for forming the single piece, wrap around cover described above. The integral blank comprises a plurality of perforations therethrough to provide compatibility with existing paper fastening systems but perforations are not mandatory. The panels of the foldable blank are so proportioned as to define a laterally elongated, generally rectangular configuration which forms the cover of the present invention when folded.

In its preferred embodiment, the integral blank comprises a plurality of juxtaposed panels having a first or end panel which can be perforated as defined above to be bound as the pages of the booklet are bound. The blank further comprises a reflex portion which is contiguous with the first panel; a spine panel contiguous with the reflex panel; a back panel contiguous with the spine panel (this cover may also stop at this point with a separate front copy bound into the booklet); an end panel contiguous with the back panel; and a front panel contiguous with said end panel. The front panel is extendable toward or under and at least into contact with the reflex panel to effect complete wrap around.

It is therefore an object of the present invention to provide a single piece, wrap around cover having a spine panel designed which can be usable for identification of the bound pages enclosed.

It is another object of the present invention to provide a single piece, wrap around cover which fully encloses all four sides of a volume to provide enhanced protection therefore, even possibly for mailing with or without envelope.

It is another object of the present invention to provide a novel wrap around cover comprising a single blank of heavier sheet material if necessary that is scored and possibly punched prior to use to define a plurality of juxtaposed panels capable of being bound with a stack of papers and then being folded for enclosure of the bound papers.

It is another object of the present invention to provide a single piece, wrap around cover for bound pages that is inexpensive in manufacture, simple in design and trouble free when in use.

It is another object of the present invention to provide an integral blank of foldable material for forming the single piece, wrap around cover or modified back with or without a separate front as described above.

Other objects and a fuller understanding of the invention will be had by reference to the following description and claims, drawn to a preferred embodiment thereof, taken in conjunction with the accompanying drawings wherein like reference characters refer to similar parts throughout the several views and in which:

DESCRIPTION OF THE PREFERRED EMBODIMENTS OF THE INVENTION

Figure 1:
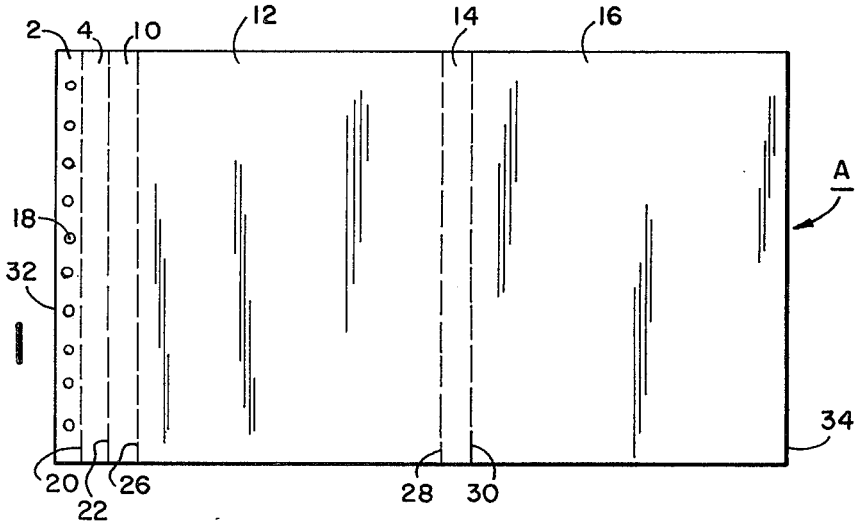
FIG. 1 is a plan view of a preferred embodiment of the wrap around cover of the present invention.

Although specific terms are used in the following description for the sake of clarity, these terms are intended to refer only to the particular structure of the invention selected for illustration in the drawings, and are not intended to define or limit the scope of the invention.

Referring to the drawings, a single piece, wrap around cover of the present invention, generally designated as A, is illustrated. The cover comprises a plurality of juxtaposed panels that are defined one from the other by score lines about which the cover is folded when in use. In accordance with techniques well known to those skilled in the art, the cover can be scored and punched prior to use simultaneously with the panel forming operations by employing equipment readily available for this purpose.

As illustrated in FIG. 1, the end or binding panel 2 can be punched to provide a plurality of transversely spaced perforations 18 to receive therethrough the prongs or other fasteners of a conventional paper binding means B. The cover also includes a reflex panel 4 which is contiguous with binding panel 2. A spine panel 10, is contiguous with reflex panel 4; and is defined therefrom by the fold line 22. A back panel 12 is contiguous with the spine panel 10 and is defined therefrom by the pre-scored fold line 26. The end panel 14 is contiguous with back panel 12 and the front panel 16 is defined therefrom by the respective pre-scored fold lines 28 and 30. Preferably, the front panel 16 is of sufficient proportional width to extend at least far enough to contact the reflex panel 4 when folded about the fold lines 28, 30.

Figure 2:
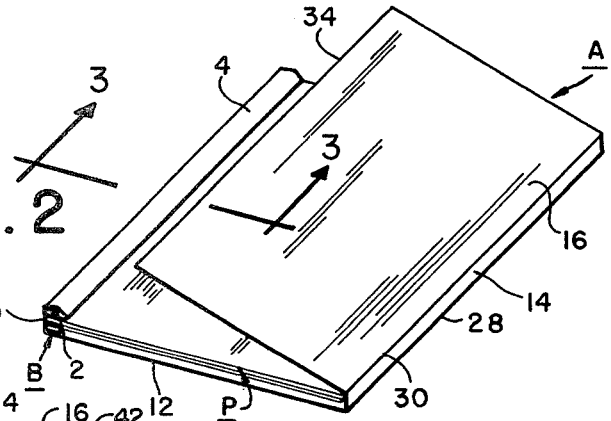
FIG. 2 is a perspective view of the cover of FIG. 1 in use.
Figure 3C:
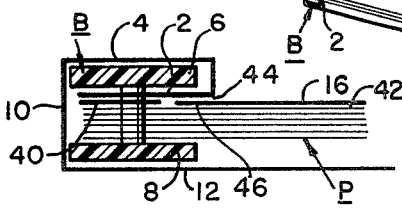
FIG. 3C is a cross sectional view similar to FIG. 3A showing a modified construction.
Figure 3A:
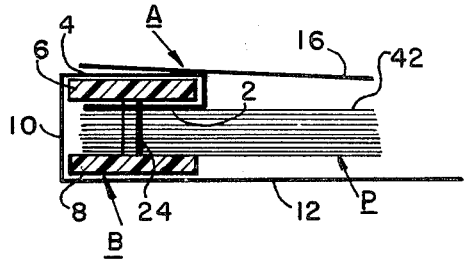
FIG. 3A is an enlarged, partial, cross-sectional view taken along line 3—3 of FIG. 2, looking in the direction of the arrows.

In use, as in FIGS. 2 and 3A, the binding panel 2 is situated between the paper P to be bound and one portion of the binding means, generally designated as B. The cover blank is preferably constructed of relatively heavy protective material such as heavy sheet plastic, heavy paper or cardboard.

As best seen in FIG. 1, the binding panel 2 can be provided with a plurality of transversely spaced perforations 18 of preselected dimension, geometric configuration and position for insertion therethrough of the paper binding or connecting portions 24 of binding means B. The connecting portions 24 extend from at least one of the bars 6 of the binding means B through the perforations 18, through corresponding openings in the bound pages P, to the opposing bar 8, thereby resulting in the bound collection of pages as illustrated in FIGS. 2 and 3A. Thus, the bound panel 2 is held in permanent position between the underside of binding means bar 6 and the first or top pages of the booklet being bound.

As further illustrated in FIG. 1, the integral blank A of foldable material is provided with selectively positioned, transverse fold lines 20, 22, 26, 28 and 30. The proportional arrangement of these fold lines along the width of the overall integral blank forms a part of the present invention. More particularly, the relative widths of back panel 12, defined between the fold lines 26 and 28, and front panel 14, defined between the fold line 30 and right edge 34, are designed so that when the front panel 14 is folded to the closed position (FIG. 3A) the right edge 34 extends into contact with the reflex panel 4.

The width of the end panel 14 defined between the fold lines 28, 30 preferably is designed to equal the width of the spine panel 10 which is defined between the fold lines 22, 26 less the thicknesses of the two binding means bars 6, 8. In this manner the width of the end panel 14 will substantially equal the thickness of the bound sheets of paper P. The widths of the binding panel 2 and reflex panel 4 are substantially equal and are preferably slightly greater than the width of the bar 6 to thereby neatly bend thereabout.

Figure 3B:
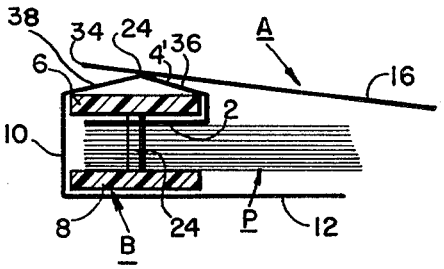
FIG. 3B is a cross sectional view similar to FIG. 3A, showing a modified reflex panel construction.

In the modification of FIG. 3B, the modified reflex panel 4 is folded back over the binding means top bar 6 and is fabricated to a greater width. The reflex panel 4 is comprised of an ascending reflex portion 36 and a descending portion 38, said portions being continuous and obliquely arched at the fold line 24 to form an apex.

In the modification of FIG. 3C, a spacer 40 is interposed between the uppermost 42 sheet or page of the bound sheets of paper P and the underside of the binding panel 2 to define a space 44 at the binding means B. The free edge 46 of the front plate or panel 16 can be inserted into the space 44, thereby providing a closed and locked wrap around cover construction. If desired, the spacer 40 can be integral with the cover blank A and may be formed as an extension plate connected to the left edge 32 of the blank A, as viewed in FIG. 1.

Referring to FIG. 1 and FIG. 3A, the reflex panel 4 is contiguous at fold line 22 with spine panel 10. The reflex panel 4 is defined by fold lines 20 and 22 and is positioned immediately adjacent to the binding panel 2. The spine panel 10 is shown to be planar and of a width sufficient to enclose both the stack of pages forming the booklet P and the binding means B. Preferably, the spine panel 10 can be imprinted to indicate the name of the author and/or material bound within. By the folding of the blank A about the fold lines 20, 22, 26, 28 and 30 to form the arrangement described, the ends of the pages P as well as the binding means B will be fully enclosed and covered from view.

Adjacent to and parallel with the back of the pages P which have been bound, the back panel 12 is defined between fold lines 26 and 28. The back panel width preferably will be slightly greater than and dictated by the width of the pages with which the cover is to be used.

When in use, the end panel 14 is bent perpendicular to back panel 12, the end panel 14 being defined between the fold lines 28 and 30. The width of the end panel 13 preferably is designed slightly less than that of the spine panel 10 and slightly greater than that of the height of the papers P enclosed. This varies in accordance with the particular volume with which the cover is to be used.

In use, as illustrated in FIGS. 3A and 3B, the front panel 16 is positioned generally parallel with the back panel 12, and is defined between the fold line 30 and right edge 34. The width of the front panel is generally the same as that of the back panel 12, the width also being dictated by the particular dimensions of the pages covered. It is contemplated that the front panel 16 may also be imprinted if desired and usually, the printing of the front panel 16 and spine panel 10 will occur simultaneously when the blank A is manufactured.

In the embodiment of FIG. 3B, the front panel 16 extends generally to a point of alignment with the plane of the spine plate or panel 10 and rests on and is supported by the reflex panel 4 at the apex formed at fold line 24. In the embodiment of FIG. 3C, the free edge 46 of the front plate or panel extends into and is retained within the space 44 which is defined between the upper sheet 42 and the binding panel 2.

While a particular type of mechanical binding means B has been illustrated, it will be appreciated that the invention is not limited to any special type of binder. The wrap around cover A of the present invention can be utilized with various types of plastic, metallic and adhesive type binding systems that are currently available with equal facility. It is the wrap around feature, and not the binding means, that forms the essence of the invention.

Thus, the bound volume is enclosed on all four sides and is provided with the protection and improved appearance heretofor unavailable.

Figure 4:
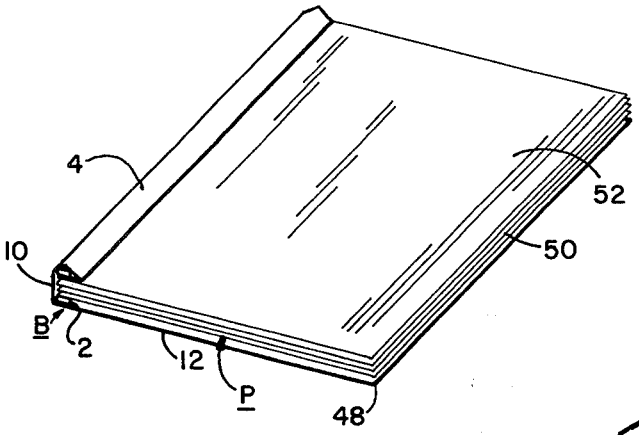
FIG. 4 is a perspective view similar to FIG. 2 showing a modified cover.

In the embodiment of FIG. 4, the cover blank A is abbreviated and includes only the binding panel 2, the reflex plate 4, the spine plate or panel 10 and the back plate or panel 12. The back plate or panel 12 terminates coextensively with the sheets of paper P at a free right edge 48. In this embodiment, the right edges 50 of the bound paper sheets remain uncovered as well as the top sheet 52. If desired, the top sheet 52 could be covered by employing a top cover (not shown) of heavy paper or sheet plastic having its left edge secured by the binding means B in the usual manner.

Figure 5:
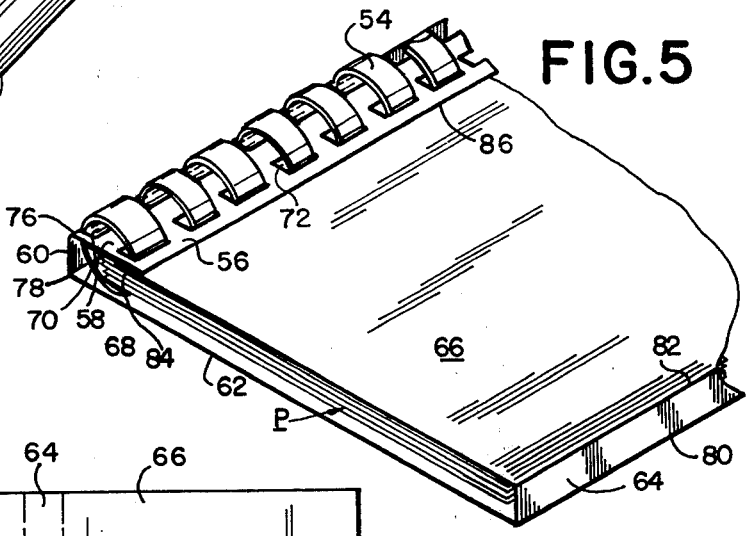
FIG. 5 is an enlarged partial perspective view of another embodiment of a wrap around cover.
Figure 6:
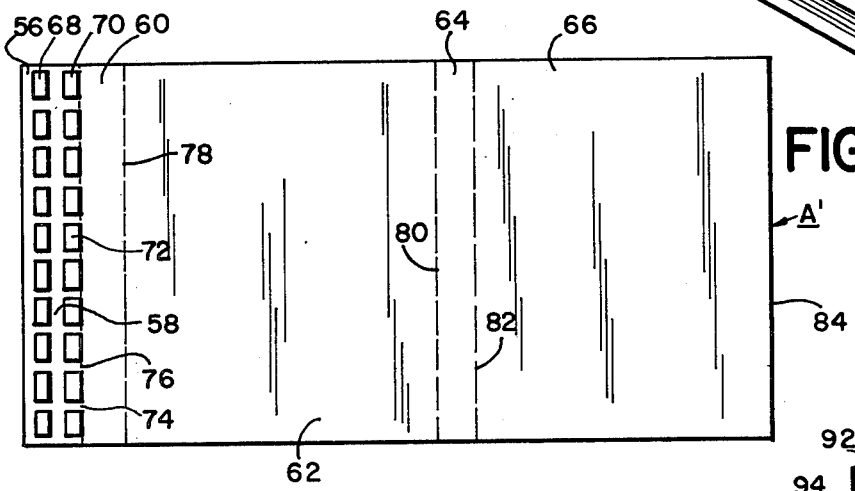
FIG. 6 is a plan view of the wrap around cover of FIG. 5.

Referring now to FIGS. 5 and 6, the invention is illustrated in use with a plastic ring type binder 54 of known design. In this embodiment, the modified blank A' comprises (from left to right in FIG. 6) a tuck panel 56, a binding panel 58, a spine panel 60, a back panel 62, an end panel 64 and a front panel 66. The binding panel 58 is punched or otherwise treated to provide a pair of similar, spaced, aligned rows 68, 70, of elongated openings 72, which openings may be rectangular in configuration. The spine panel 60 is defined from the binding panel 58 by the fold line 74 which preferable is scored when the blank A is manufactured. In the preferred arrangement, the fold line 74 aligns with one edge 76 of the aligned row 70 of openings 72.

As illustrated, the back panel 62 is defined from the spine panel 60 by the score line 78 and the blank is folded thereabout. Similarly, the end panel 64 is defined between the fold lines 80, 82 which preferably are scored in the blank. The front panel 66 extends from the fold line 82 and terminates in a free edge 84. As best seen in FIG. 5, the free edge 84 of the front panel 66 can be inserted under the free edge 86 of the tuck panel 56 to form a complete enclosure for the bound pages P. It will be noted that plastic rings comprising the ring binder 54 insert through aligned pairs of openings 72 of the rows 68, 70 for binding purposes.

Figure 7:
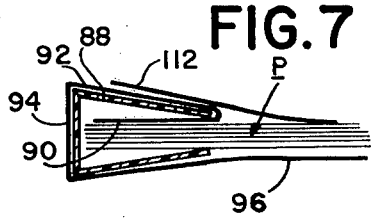
FIG. 7 is an enlarged, partial cross sectional view of another embodiment of a wrap around cover.
Figure 8:
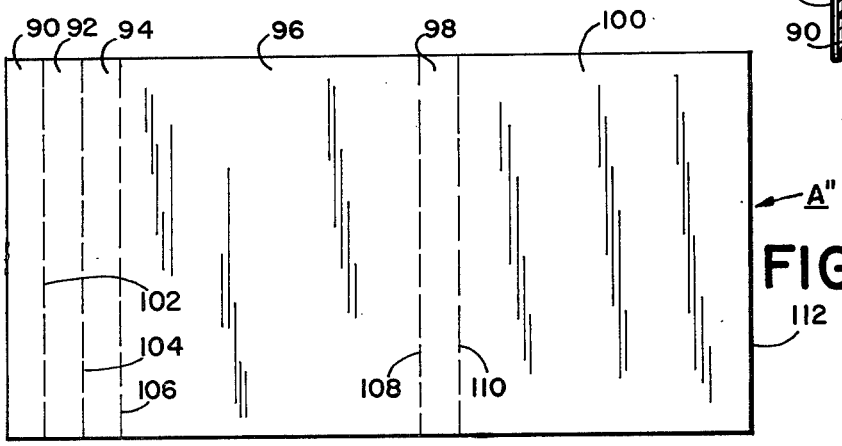
FIG. 8 is a plan view of the wrap around cover of FIG. 7.

Referring now to FIGS. 7 and 8, another embodiment of the wrap around cover of the present invention is illustrated in use with a one piece, plastic strip type binder 88. As illustrated, a modified cover blank A" is utilized wherein no holes or perforations are necessary. The cover comprises a binding panel 90, a reflex panel 92, a spine panel 94, a back panel 96, an end panel 98 and a front panel 100. The binding panel is defined from the reflex panel by the score line 102. The reflex panel 96 is defined from the spine panel 94 by the score line 104. The back panel 96 is defined from the spine panel 94 by score line 106 and from the end panel 98 by the score line 108. Similarly, the front panel 100 is defined from the end panel 98 by the score line 110 and terminates in a free edge 112. As best seen in FIG. 7, the modified blank A" is bent about the score lines 102, 104, 106, 108, 110 to form a wrap around cover to fully enclose the bound pages P. The free edge 112 closes against the reflex panel 92 to complete the enclosure. If desired the panels 90, 92 may be slightly widened to allow the fold or score line 102 to extend forwardly of the stip binder 88, thereby to provide an extended area under which the free edge 112 can be tucked.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A wrap around cover for enclosure of a stack of papers having a front, a back, a linear spine edge and a front edge which are secured by a mechanical binder at the spine edge comprising an integral cover blank which is defined by a binding panel underlying at least a part of the binder and covering a portion of the front of the stack, the binding panel being adapted to be secured to the paper stack by the binder, the binding panel terminating in a linear edge, the linear edge of the binding panel being adapted to overlie the linear spine edge of the stack of papers;

a spine panel connected directly or indirectly with said binding panel and covering the said spine edge, a back panel contiguous with said spine panel and covering the said back an end panel contiguous with the back panel and covering the said front edge; and a front panel contiguous with the end panel and covering the front of the stack of papers, the said front panel terminating in a linear free edge, the front panel linear edge being adapted to overlie at least a part of the binding panel.

2. The wrap around cover of claim 1 and a reflex panel intermediate the binding panel and the spine panel, the blank being bent at the respective interconnections of the binding panel and reflex panel and the reflex panel and spine panel, the reflex panel being adapted to overlie and cover at least a part of the mechanical binder.

3. The wrap around cover of claim 2 wherein the back panel covers at least a portion of the binder.

4. The wrap around cover of claim 2 wherein the free edge extends under a portion of the binder and the binding panel and is secured thereby.

5. The cover of claim 1 wherein the binding panel and the stack of papers are perforated and wherein portions of the mechanical binder insert through the perforations and secure the cover to the stack of papers.

6. The wrap around cover of claim 2 wherein the reflex panel is angular and forms an apex and wherein the apex is positioned to be contacted by the front panel.

7. The wrap around cover of claim 2 wherein the spine panel and end panel are generally perpendicular to the back and front panels.

8. The wrap around cover of claim 5 wherein the perforations comprise a plurality of more than two holes, said holes being aligned in a row whereby the portions of the binder can be inserted through the holes.

9. The wrap around cover of claim 8 wherein said holes are round.

10. The wrap around cover of claim 5 wherein the perforations comprise a plurality of more than two holes, said holes being aligned in two rows whereby the portions of the binder can be inserted through the two rows of holes.

11. The wrap around cover of claim 10 wherein the rows are similar, parallel and spaced apart.

12. The wrap around cover of claim 11 wherein the holes are rectangular in configuration.

13. The wrap around cover of claim 1 wherein the front panel linear free edge is adapted to insert under the binding panel to complete the wrap around enclosure.

14. The wrap around cover of claim 1 and a spacer interposed between the front of the stack of papers and the binding panel, said spacer being adapted to define a clearance space between the said front of the stack of papers and a portion of the mechanical binder.

15. The wrap around cover of claim 14 wherein the linear free edge of the front panel is adapted to be inserted into the clearance space to provide a closed and locked wrap around cover construction.

16. The wrap around cover of claim 15 wherein the thickness of the spacer is the same as the thickness of the cover front panel.

* * * * *